US005718277A

United States Patent [19]

Prosch

[11] Patent Number: 5,718,277

[45] Date of Patent: Feb. 17, 1998

[54] ROLLER BLIND

[76] Inventor: Dieter Prosch, Flachsland 39, 22083 Hamburg, Germany

[21] Appl. No.: 546,153

[22] Filed: Oct. 20, 1995

[51] Int. Cl.[6] ..... A47G 5/02

[52] U.S. Cl. ..... 160/321; 160/332; 160/171 R; 160/344

[58] Field of Search ..... 160/84.01, 84.04, 160/170 R, 171 R, 319, 321, 332, 344, 398, 403, 404

[56] References Cited

U.S. PATENT DOCUMENTS

| | | | |
|---|---|---|---|
| 3,160,202 | 12/1964 | Rosen | 160/344 |
| 3,322,182 | 5/1967 | Palella | 160/344 |
| 3,856,072 | 12/1974 | Sund | 160/344 X |
| 4,899,796 | 2/1990 | Easley et al. | 160/84.01 |
| 4,919,186 | 4/1990 | Uecker et al. | 160/321 |
| 5,524,690 | 6/1996 | Brtoloso et al. | 160/84.01 X |

FOREIGN PATENT DOCUMENTS

| | | |
|---|---|---|
| 3717061 | 9/1988 | Germany . |
| 3931090 | 3/1991 | Germany . |
| 4128485 | 5/1992 | Germany . |
| 9207916 | 10/1992 | Germany . |
| 9304886 | 7/1993 | Germany . |
| 653537 | 1/1986 | Switzerland . |

*Primary Examiner*—Kenneth J. Dorner
*Assistant Examiner*—Bruce A. Lev
*Attorney, Agent, or Firm*—Friedrich Kueffner

[57] ABSTRACT

The roller blind (100) detachably fastened to a winding axis (50) can be rolled up on to and unrolled from the winding axis with the aid of pull cords, in which case the pull cords (20, 120, 220) are constructed in the form of U-like routed pull cord pairs (21, 121, 221) passed through guide rings (30, 31, 130, 131, 230, 231) with concentric pull cord connecting sections (24, 124, 224) proceeding parallel to the longitudinal axis of the winding shaft (50) and located on top of each other, which are seized for the rolling up and the unrolling operation of the window shade by a pull cord entrainment means (60) secured concentrically to the circumference of the winding axis (50).

18 Claims, 10 Drawing Sheets

Fig.13
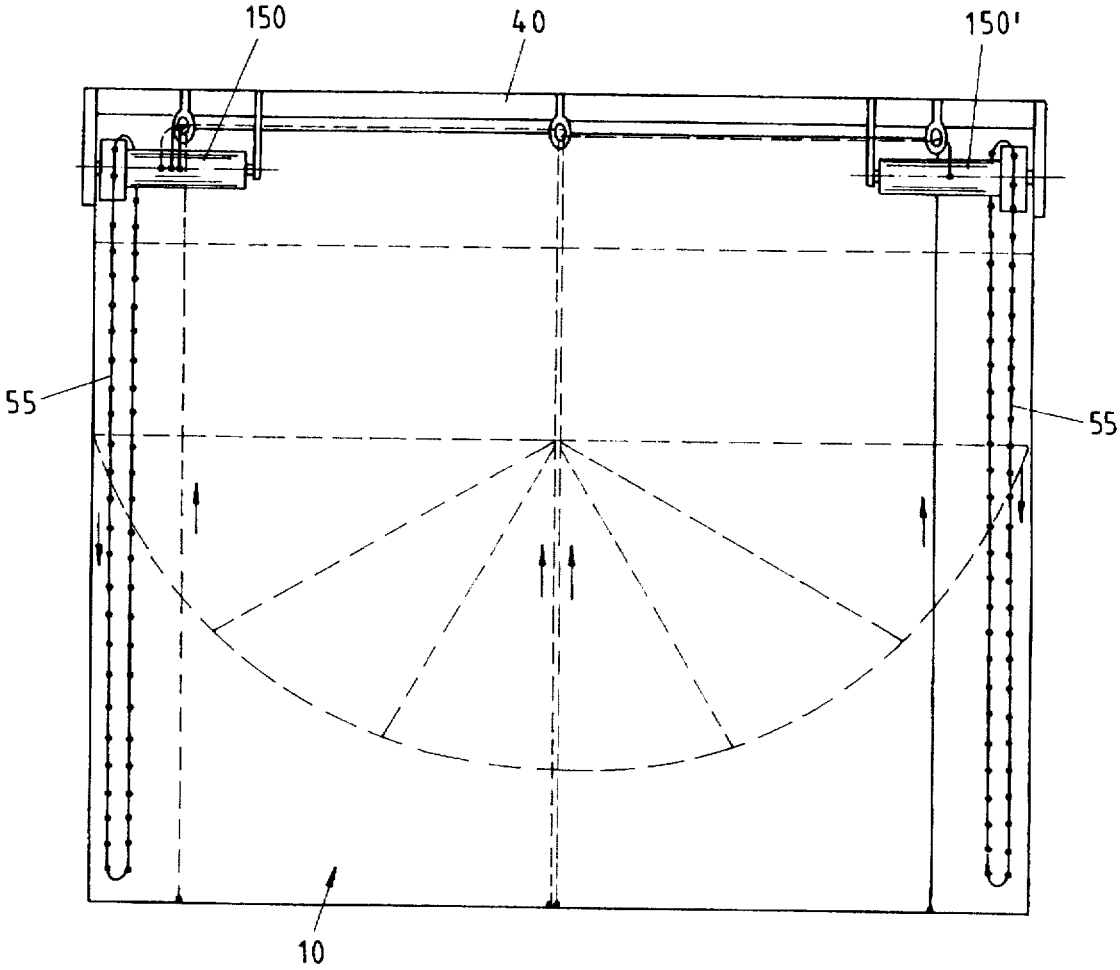
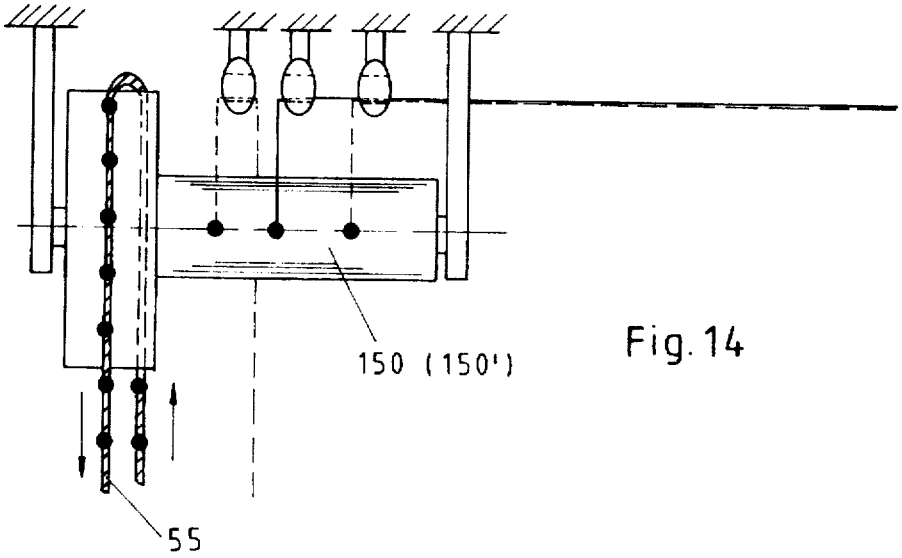
Fig. 14

ROLLER BLIND

BACKGROUND OF THE INVENTION

1. Field of the Invention

The invention relates to a roller blind, comprising a window shade which is detachably attached with its upper marginal edge, a winding axis rotatably supported on the mounting rail near the upper marginal edge of the window shade provided at one end with a drive means operable with the aid of a control cord or control chain for a plurality of pull cords that can be wound on to the same and which, at one end, are secured to the lower marginal border of the window shade and are passed through guide loops arranged so as to be distributed between the upper marginal edge and the lower marginal edge of the window shade and of a plurality of guide rings disposed within the area of the winding axis, which are mounted so as to be fixed or detachable and through which the pull cords are passed.

2. Description of the Related Art

Roller blinds constructed in such a way are known. Thus the DE 41 28 485 A1 describes a roller blind which comprises at least one web of fabric, whose top border is secured to a fixed carrier and upon which a plurality of guide elements with guide apertures for a passed-through pull cord is mounted, whose upper end is connected to a device for drawing the pull cord up and for lowering the same. In this roller blind, a series of guide elements for a pull cord is attached to each web of fabric which, from a point located relatively close to one of the corner points of the web of fabric, extends at least across the main portion of the width of the web of fabric to an obliquely oppositely located point of the same, in which case the top end of the pull cord passed through this series of guide elements is connected to a device for its drawing up and lowering, for instance, a winding up roller or provided with a stopping means, e.g. such as a winding cord according to the DE 37 17 061 A1. The winding up and the unwinding of the pull cords is effected by means of rotating the roller or the winding axis to which the pull cords are fixedly or detachably secured at one end and this with the aid of a pull chain.

In the known roller blinds, for the tightening of the window shade, a winding of the pull cords on to the winding axis that can be actuated with the aid of a pull chain, which is supported on the mounting rail, is carried out. If the pull cords are rigidly connected with their ends facing the winding axis, in that case additional means have to be provided on the window shade in order to disengage this operative connection between the pull cords and the winding axis. Another possibility is provided by the detachable attachment of the pull cords to the winding axis.

According to the DE 92 07 916 U1, the winding axis for roller blinds is constructed with a separable attachment comprised of plug-like shaped members retained in accommodation apertures for the winding axis for the ends of the pull cords on the winding axis in such a way that the winding axis is provided with a longitudinal groove which, within its bottom wall area, possesses a number of accommodation openings disposed so as to be spaced apart, such as drilled holes or through bores, for receiving the plug or stopper-like shaped members which are inserted into the drilled holes or through bores in such a fashion that the surfaces of their head-like sections pass continuously variable into the plane formed by the circumference of the winding axis. Each pull cord of the window shade is secured to a thusly configured plug-like shaped member. Since roller blinds, more particularly when the same possess greater widths, are provided with a great many pull cords, it is necessary to secure also a number of plug-like shaped members which number corresponds to that of the pull cords fastened to the winding axis, which has to be provided with the relevant number of drilled holes and through bores for receiving the plug-like shaped members.

A further detachable attachment mode is described by the DE 93 04 886 U1. In this case, a roller blind with pull cords, whose lower ends are attached to the bottom border edge of the window shade fabric and whose top ends are attached to a rotatably supported winding axis, while the top ends of the pull cords on the side of the winding axis are passed through guide rings fixedly mounted between the upper marginal border of the window shade fabric and where the attachment of each pull cord to the winding axis is effected with the aid of a stopper-like shaped member fastened to the pull cord end by means of press fit in an accommodation aperture constructed in the wall area of the winding axis, such as e.g. a drilled hole or through bore, is designed in such a way that the shaped member possesses a configuration and cross-sectional dimensions that correspond to those of the aperture formed by the guide ring wherein the inserted shaped member is retained by means of force and press fit.

Also the DE 39 31 090 A1 describes a take-up means for the pull cords of roller blinds, in which case the top ends of the pull cords are secured to a rigidly mounted, rotatable winding axis on to which they can be wound or from which they can be unwound, whereby the window shade is raised or lowered. The risk of a reciprocal entanglement and intertwining of the individual pull cords when removing and/or remounting is avoided in that the top end of each pull cord, prior to its attachment to the winding axis, is passed through a guide element fixedly disposed above the same.

The detachable attachment of the pull cords to the winding axis calls for a substantial technical expenditure with the result that the taking down of the window shade from the mounting rail carrying the winding axis is both laborious and time-consuming since the pull cords have to be individually separated from the winding axis. In the reverse case, appending the e.g. dry-cleaned shade is in a like manner laborious and time-consumning because, after the window shade has been fastened to the mounting rail, the individual pull cords have to be secured to the winding axis.

The separable attachment of a window shade to a light metal rail with the aid of a Velcro-type fastener is described in the CH 653 537. In this case, the one strip of the Velcro fastener is connected with the upper marginal border of the window shade and the other strip with the rail which presses upon lateral bands which engage around the longitudinal rims of the allocated strip and press clampingly against the rail surface area, whereby it is possible to establish a connection of the Velcro fastener with a light alloy rail.

It is the technical problem of the present invention to provide a roller blind according to the type described in the beginning with two components to be moved into operative connection which can be separated again from each other which, on the one hand, are constituted by the mounting rail with the pull cord winding axis and, on the other hand, by the window shade with pull cords, while the establishment and the detachment of the connection of the pull cords is controlled with or by the winding axis by means of the rotational movement of the winding axis during the actuation operation for rolling up or unrolling the window shade.

In accordance with the present invention, the window shade, on its rear, possesses at least one pull cord passed in a U-like configuration through two guide rings secured to the window shade adjacent to the upper marginal border of the same with two pull cord sections proceeding transversally to the winding axis and secured with their free ends to the lower marginal edge of the window shade and with a pull cord connecting section formed between the two guide rings and proceeding parallel to the winding axis so as to connect the pull cord sections and in that the winding axis, on its circumference, carries at least one cam-like or hook-shaped pull cord carrier located with its circumferential region within the area of the pull cord connecting section which, in the unwound state of the window shade, is disengaged from the pull cord connecting section and which, for the winding up of the pull cords on to the winding axis, with the shade winding up operation takes place while the winding axis is revolving, seizes the pull cord connecting section.

With a roller blind constructed in such a way according to the invention the possibility exists for the first time of detaching and establishing an operative connection between the pull cords of the roller blind and the winding axis without an expensive technique being required for this. In the unwound or unrolled state of the blind, the pull cord entrainment means on the winding axis is out of engagement with the pull cord carried or routed in a U-like fashion on the rear of the blind while, already at the beginning of the revolving movement of the winding axis, the pull cord entrainment means seizes the pull cord with its section located within the area of the winding axis so that, in the course of a further rotation of the winding axis, the pull cord seized by the pull cord entrainment means is wound on to the winding axis, on which occasion the blind is tautened. The operative connection between the pull cord and its winding axis is controlled by means of the direction of rotation and movement of the winding axis so that, in the unrolled state of the shade, the same can be effortlessly separated from the mounting rail. The detachable attachment of the shade to the mounting rail is advantageously effected by means of a connection constructed along the lines of a Velcro fastener, i.e. a hook and loop-type fastener, so that not merely the detachment of the shade from the mounting rail can be effortlessly carried out by anybody. Owing to the design of the roller blind according to the invention it is no longer necessary to detach the pull cords individually from the winding axis or to be connected to the same. Merely a U-configured guidance of the pull cords on the shade and a pull cord entrainment means on the winding axis suffice for making such an advantageous roller blind available to owners and occupiers of apartments or such like accommodation.

If the window shade of the roller blind possesses a more substantial width, then a greater number of pull cords will also be required. However, what is essential at all times is that each pull cord be carried or routed in a U-configured fashion on the rear of the blind and that, on the blind, a number of guide rings be attached in such a way that pull cord sections proceeding parallel to the winding axis are formed so that the same can be seized by the entrainment means on the winding axis for the winding or rolling up process of the pull cords. The deposition of the guide rings on the blind is effected within the area of the winding axis in such a way that the pull cord sections proceeding parallel to the winding axis are located within the revolving motion range of the pull cord entrainment means when the same is set in motion by means of the rotational movement of the winding axis. Each pull cord is formed by a pair of pull cords from pull cord sections proceeding transversally to the winding axis and one pull cord connecting section connecting these pull cord sections within the area of the winding axis. If, on the rear of the blind, several U-like routed pull cords are provided, then their arrangement is effected in such a manner that the pull cord section of a differing length formed on the blind and proceeding parallel to the winding axis are located so close to each other that all these pull cord sections can be taken hold of by the pull cord entrainment means.

Advantageous constructions of the invention are characterized in the subclaims.

BRIEF DESCRIPTION OF THE DRAWINGS

Embodiment examples of the invention are described in greater detail below with the aid of the drawings. Thus

FIG. 13 shows in a front view a roller blind with raisable and spreadble in a fan-like fashion window shade while use is made of two winding axes which can be actuated independently of each other;

FIG. 14 shows, in an enlarged view, a winding axis in a short version with the pull cord guide means;

DESCRIPTION OF THE PREFERRED EMBODIMENTS

Figure 1:
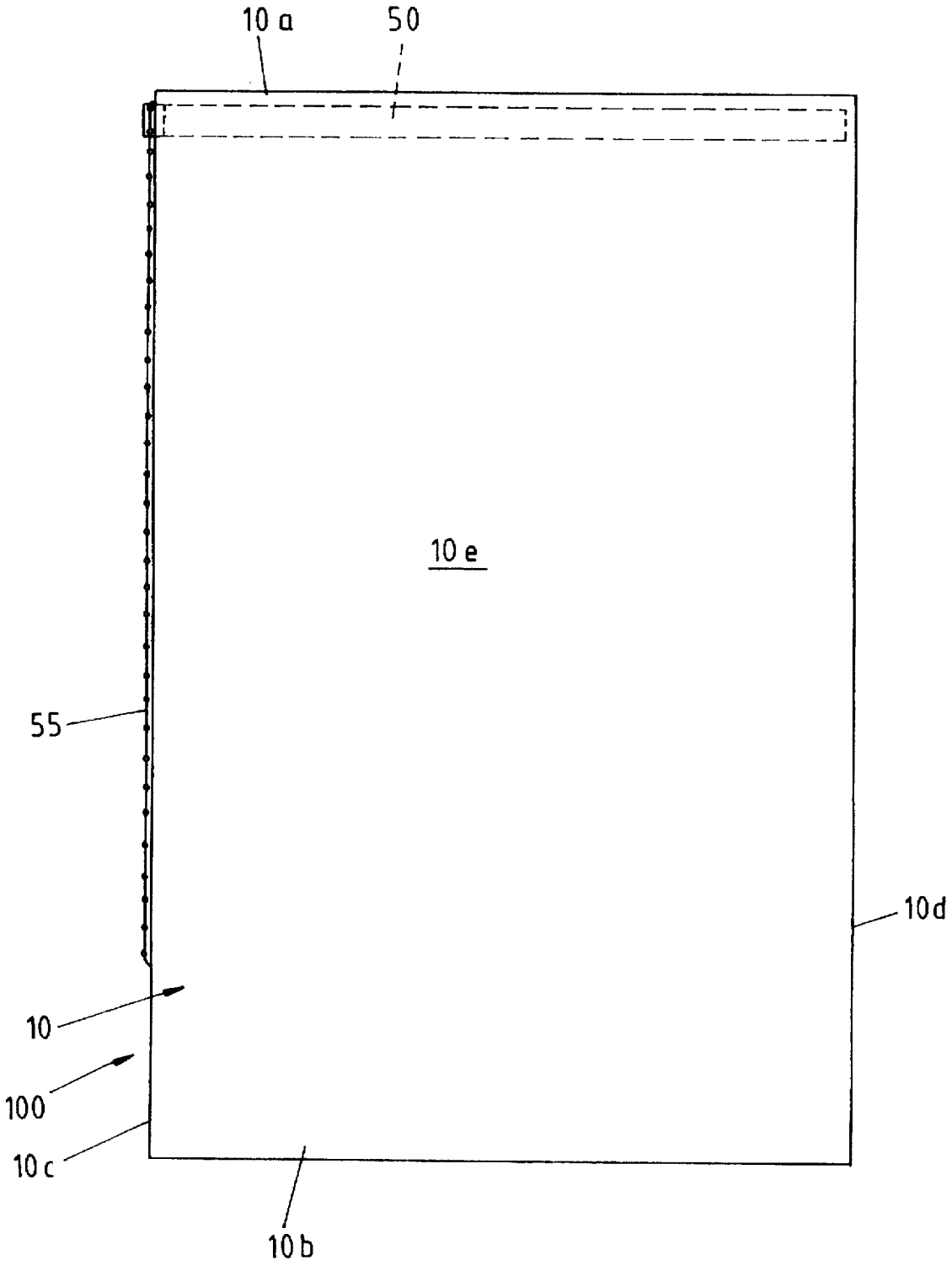
FIG. 1 shows a front view of the roller blind with mounting rail and drawn or unrolled window shade.
Figure 2:
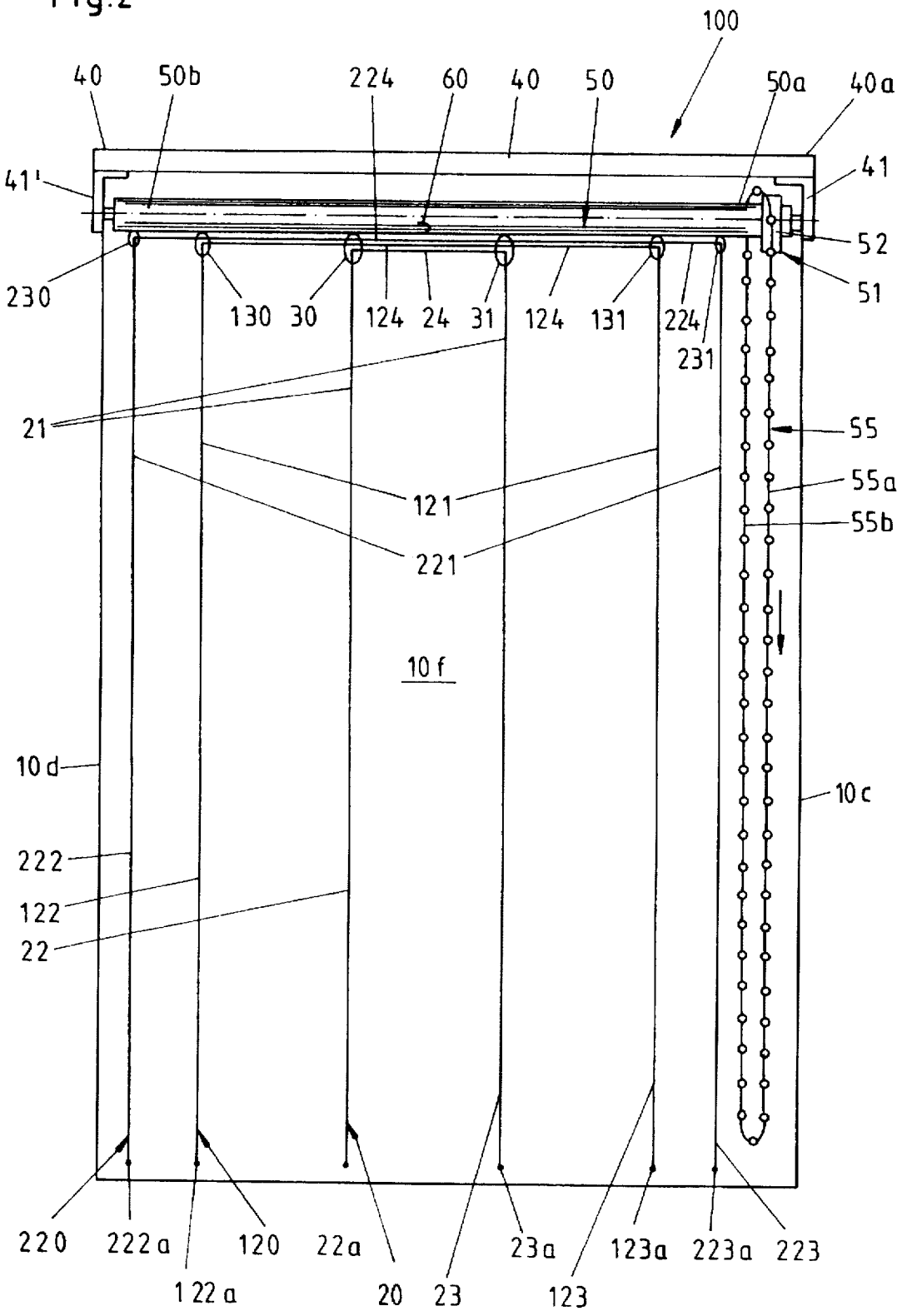
FIG. 2 shows a rear view of the roller blind with drawn or unrolled window shade.
Figure 3:
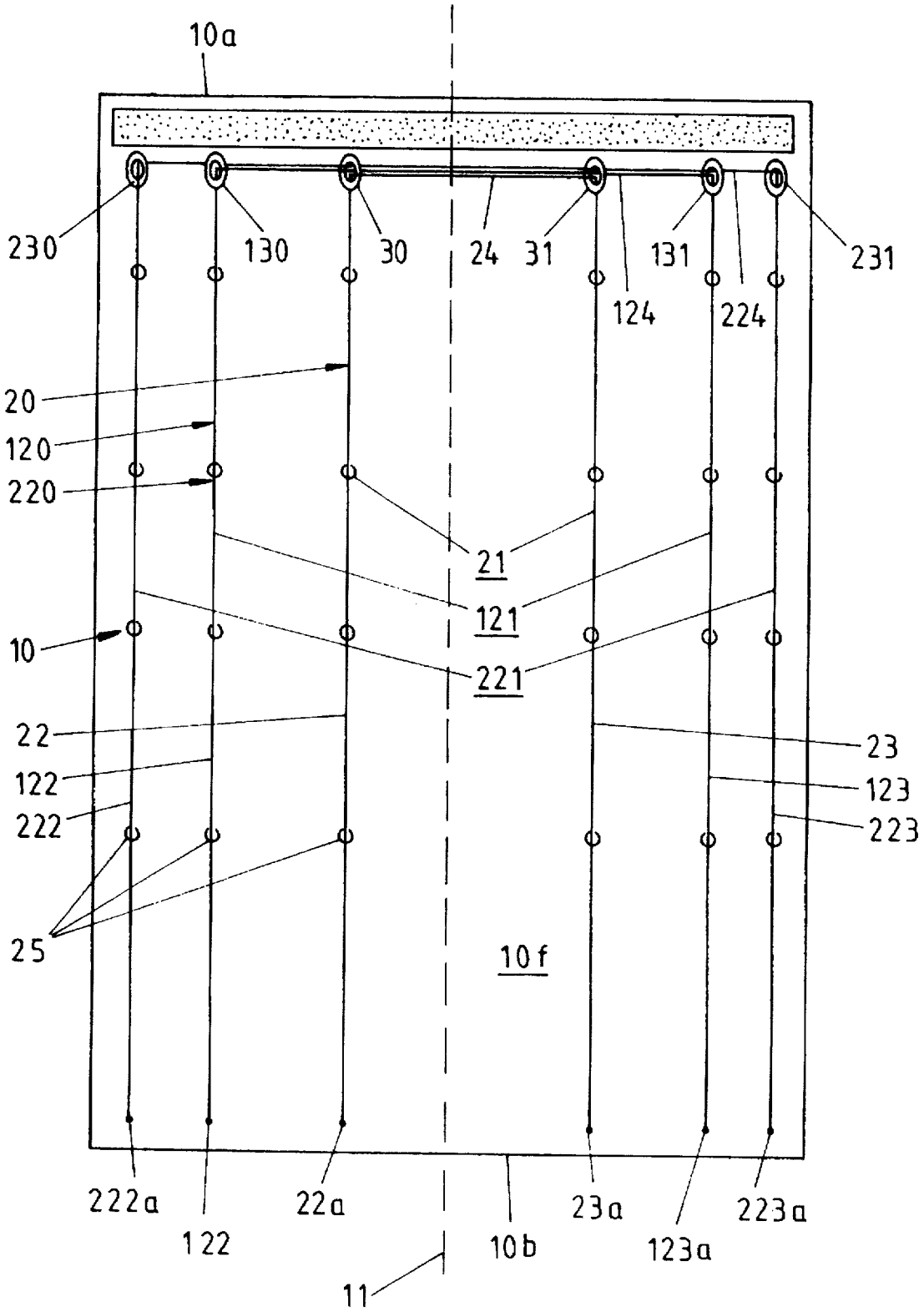
FIG. 3 shows a rear view of the drawn or unrolled window shade with the pull cord and the guide and rerouting rings for the pull cords of three pull cord pairs.

The roller blind 100 illustrated in FIGS. 1, 2 and 3 comprises a window shade 10 of a rectangular or square fabric blank with the upper marginal edge 10*a*, the lower marginal edge 10*b* and the two vertically proceeding lateral marginal borders 10*c*, 10*d*. This window shade 10 is, with its upper marginal edge, detachably attached to a mounting rail 40, which is expediently effected with the aid of a Velcro fastener type connection. It is possible, however, for other detachable fastening means, such as e.g. a button connection, zip fastener connection or the like to also be employed.

The front of the window shade 10 is designated with 10*e* and the rear of the window shade with 10*f*. The center of the window shade 10 is identified by means of a longitudinal center line 11 (FIG. 3).

The rolling up of the window shade 10 is effected by means of pull cords 20 or 120 or 220, which are formed as pull cord pairs 21 or 121 or 220. The number of the pull cords does in each case depend on the width of the window shade 10. The pull cords are always combined in pairs.

Each pull cord 20, 120, 220 is retained on the rear 10*f* of the window shade 10 with the aid of guide loops 25 on the window shade 10 and has a U-configured run, i.e. a course which corresponds to an upside-down, "U", while forming pull cord sections 22, 23 proceeding parallel to the lateral marginal borders 10*c*, 10*d* of the window shade 10, which, adjacent to the upper marginal edge 10*a* of the window shade 10, are connected by means of a pull cord connecting section 24, in which case this pull cord connecting section 24 proceeds parallel to the upper marginal edge 10*a* of the window shade 10, this being brough about by rerouting the pull cord 20 through guide rings 30, 31 which, adjacent to the upper marginal edge 10*a* of the window shade 10, are secured to the same in such a fashion that, by preference, the two guide rings 30, 31 for the pull cord 20 are located on both sides of the longitudinal center line 11 of the window shade 10 (FIG. 2).

The pull cord section 22, 23 or the pull cord pair 21, which constitutes the pull cord 20, are, with their ends 22*a*, 23*a* adjacent to the lower marginal edge 10*b* of the window shade 10, secured to the same (FIG. 2).

The number of the pull cords routed in a U-configured manner on the rear 10*f* of the window shade 100 depends in each case on the width of the window shade 10. In the embodiment example depicted in the FIGS. 2 and 3, the window shade 10 possesses three pull cords 20, 120, 220, which a re constituted of the pull cord pairs 21, 121, 221. The pull cords 120, 220 are constructed so as to correspond to the pull cord 20; they possess pull cord sections 122, 123 and 222, 223 proceeding parallel to the lateral marginal borders 10*c*, 10*d* of the window shade 10, which, adjacent to the upper marginal edge 10*a* of the window shade 10, are connected by means of pull cord connecting sections 124, 224. Adjacent to the lower marginal edge 10*b* of the window shade 10, these pull cord sections 122, 123 and 222, 223 are secured to the window shade 10 with their ends 122*a*, 123*a*, 222*a*, 223*a*. All pull cords 20, 120, 220 are routed in a U-like fashion with the aid of a pertinent number of guide rings 130, 131 and 230, 231 attached to the window shade 10 adjacent to the upper marginal edge 10*a* of the same, in which case all guide rings 30, 31 and 130, 131 and 230, 231 are disposed so as to be located in a row so that the pull cord 20 is passed through the guide rings 30, 31 and rerouted while, at the same time, the pull cord connecting section 124 proceeding parallel to the upper marginal edge 10*a* of the window shade 10 is additionally passed through the guide rings 30, 31. The pull cord 120, too, is routed in a U-configured manner, the guidance and the rerouting being effected with the aid of the guide rings 230, 231. The pull cord connecting section 224 proceeding parallel to the upper marginal edge 10*a* of the window shade 10 of the pull cord 220 is then additionally passed through the guide rings 130, 131 and 30, 31 so that, within the central area of the window shade 10, three closely adjacent pull cord connecting sections 24, 124, 224 are located (FIG. 3).

Figure 4:
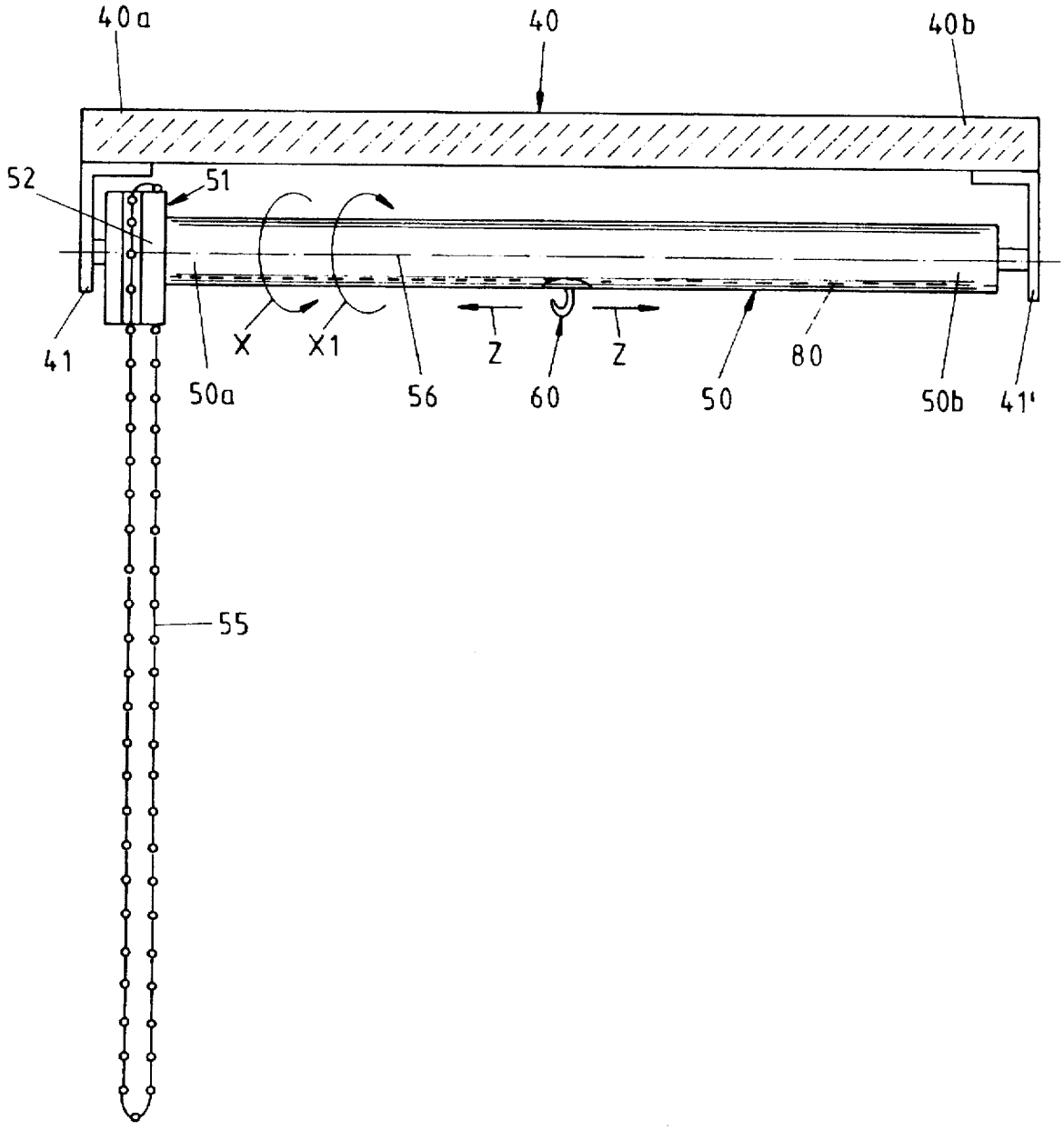
FIG. 4 shows a front view of the mounting rail with the winding axis carrying the pull cord entrainment means for the pull cords.

The mounting rail 40 of the roller blind 100 serves to acnchor the same on a ceiling or a wall within a window area. The two ends 40*a*, 40*b* of the rod-like mounting rail 40 carry bearings 41, 41' for a winding axis 50 for the pull cords 20, 120, 220 (FIG. 4).

The winding axis 50 for the pull cords is constructed in the form of a cylindrical shaft member and is comprised of a hollow axis pr a solid axis. On the terminal areas 50*a*, 50*b*, the winding axis 50 carries bearing pins which are supported in the bearings 41, 41' of the mounting rail 40 so that the winding axis 50 is rotatable about its shaft axis 56 X, X1. The actuation of the winding axis is effected with the aid of a drive means 51 by means of an operating cord or operating chain 55, it being also possible for electromotive drive means to be employed, which is carried via a drum 52 of the drive means 51 disposed on the end 50*a* of the winding axis 50. By pulling one or the other of the strands 55*a*, 55*b* of the operating or actuating chain 55, the winding axis 50 is set into rotation and this either into one or the other direction.

On its circumference, the winding axis 50 carries at least one lifting cam or hook-shaped pull cord entrainment means 60, located with its circumferential area, within the region of the pull cord connecting section 24 or of the pull cord connecting sections 124, 224, said entrainment means, in the unrolled state of the windows shade 10, are out of engagement with the pull cord connecting section or sections 24, 124, 224 and which, for winding up the pull cords 20, 120, 220 or their pull cord sections 22, 23 and 122, 123 and 222, 223 on to the winding axis 50 during the window shade rolling up operation while the winding axis 50 is revolving, seizes the pull cord connecting sections 24, 124, 224.

As is depicted in the FIG. 2, the guide rings 30, 31 and 130, 131 and 230, 231 on the window shade 10 for the pull cords 20, 120, 220 on both sides of the longitudinal center line 11 of the window shade 10, are secured to the same (FIG. 3). In this manner, on each side of the longitudinal center line 11 on the window shade 10, three guide rings, viz. 30, 130, 230 and 31, 131, 231 are secured, while the spacings of the two guide rings 30, 31 for the pull cord 20, the guide rings 130, 131 for the pull cord 120 and the guide rings 230, 231 for the pull cord 220 from the longitudinal center line 11 of the window shade 10 are identical.

Figure 9A:
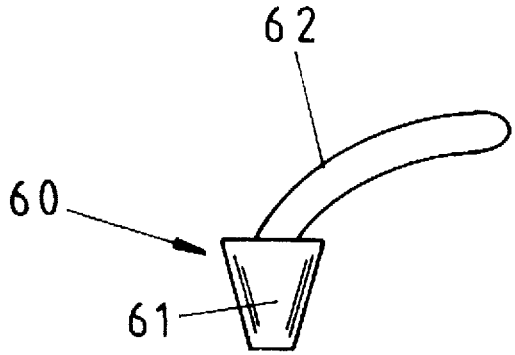
FIGS. 9A, 9B, 9C show different constructions of the pull cord entrainment means in the form of hooks and lifting catches.
Figure 9B:
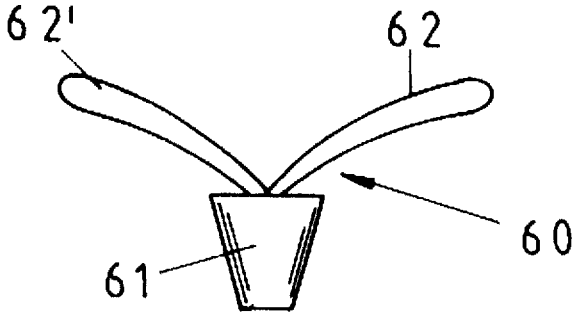
Figure 9C:
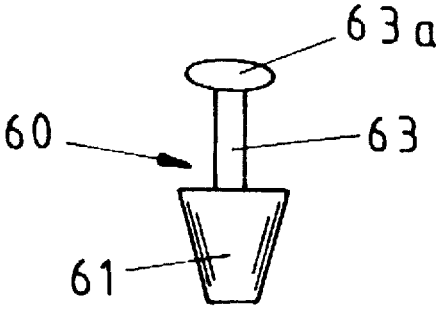

The pull-cord entrainment means 60 may possess the most widely varied constructions and configurations. According to an embodiment as per FIGS. 9*a*, 9*b* and 9*c*, the pull cord entrainment means 60 is comprised of a stopper-like shaped member 61 which, as per FIG. 9*a*, is provided with a hooked section 62 or, according to FIG. 9*b*, with two oppositely directed hook-like sections 62, 62'. Also the embodiment according to FIG. 9*c* is comprised of a stopper-like shaped member 91 which carries an entrainment cam 63, in which case said entrainment cam 63, on its free end, is provided with a button-like enlarged portion 63*a* in order to be able to act as an entrainment means. The possibility also exists of providing the stopper-like configured member 61 with a screw-like configured member, in which case the head-like construction of the screw-like configured member then possesses the function of an entrainment means. This construction of the pull cord entrainment means 60 has the advantage that, on the one hand, the pull cords are securely seized for the rolling up operation and, during the rolling or winding up process, are also secured against slipping off and, on the other hand, an effortless unhooking from the pull cords is ensured.

If the pull cord entrainment means 60 possess a stopper-like shaped member 61, the winding axis 50, on its circumference, is provided with a plurality of recesses or perforations into which these stpper-like shaped members 61 of the pull cord entrainment means 60 are inserted. If these stooper-like shaped members 61 are comprised of a sprngably resilient plastic, in that case the pull cord entrainment means 60 are retained by means of press fit in the recesses or through bores in the wall of the shaft body of the winding axis 50. Additional connecting possibilities exist in that this type of pull cord entrainment means 60 is then additionally secured by means of bonded connections. The entrainment means 60 in the embodiments according to FIGS. 9*a*, 9*b*, 9*c* may be comprised of plastics, metallic materials or other suitable materials.

Figure 10:
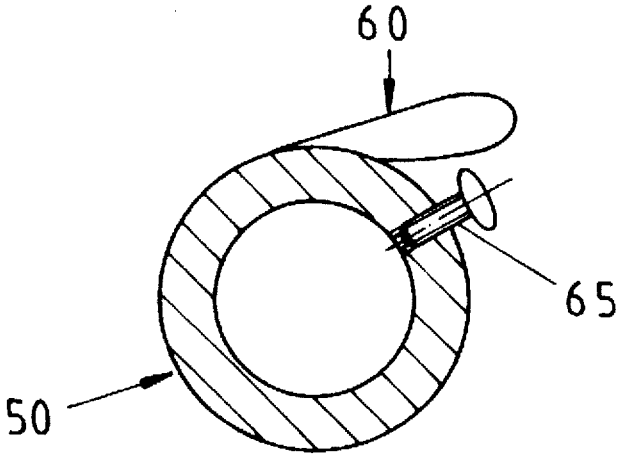
FIG. 10 shows a vertical cross-section through the winding axis with a pull cord entrainment means formed on to the shaft member.

However, the possibility also exists of providing the shaft member of the winding axis 50 with a pull cord entrainment means 60 which, on the external circumference of the winding axis 50 is formed on in such a fashion that a hook-shaped configuration results. In this embodiment, the pull cord entrainment means 60 is then comprised of the same material from which also the winding axis 50 is fabricated. FIG. 10 additionally shows a further embodiment inasmuch as an entrainment screw 65 is screwed into the shaft member of the winding axis 50, which possesses the same function as the pull cord entrainment means 60 constructed in the form of a lifting cam or hook-like element. There also exists the possibility of securing the pull cord entrainment means 60 with the aid of a screwed connection to the winding axis 50. It is also possible to employ embodiments of pull cord entrainment means which differ from those illustrated in the drawings and described in the foregoing. What is essential is that the pull cord entrainment means 60 is secured to the external circumference of the winding axis 50 and that is possesses a design, by virtue of which the pull cord entrainment means 60 seizes the pull cords for the rolling or winding up operation and is also capable of releasing the same when it is intended to remove or detach the window shade 10 from the mounting rail 40.

According to the FIGS. 5 to 8, the roller blind 100 is employed as detailed in the following.

Figure 5:
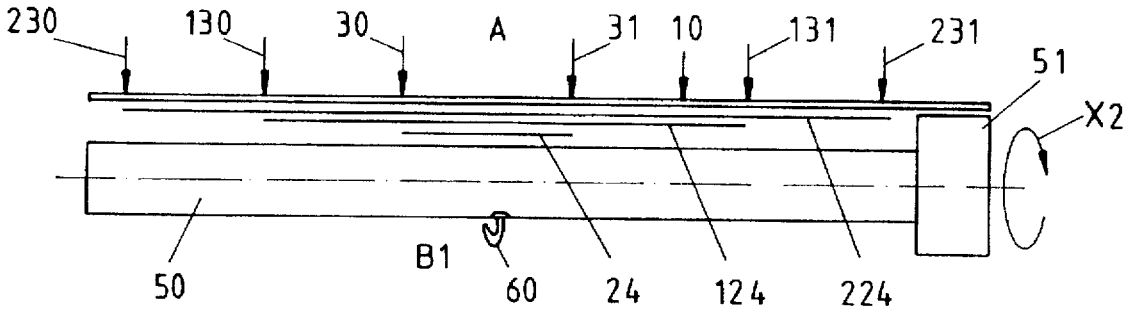
FIG. 5 shows a schematic view from the top of the window shade with the pull cords and the winding axis with the pull cord entrainment means in a non-engaged position with the pull cords with the window shade in the drawn or unrolled position.
Figure 6:
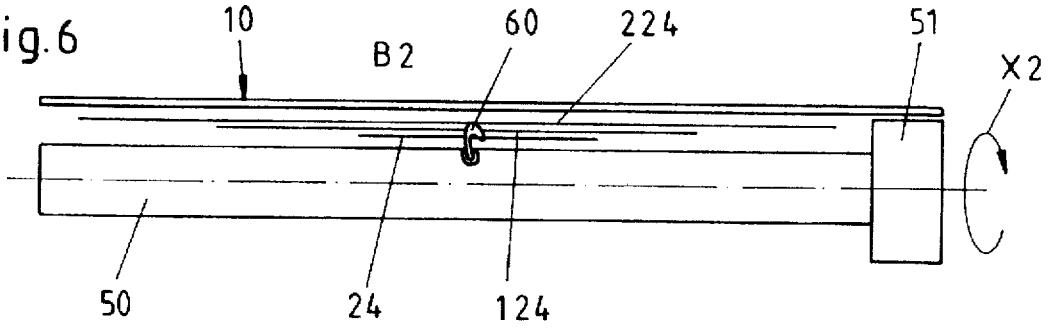
FIG. 6 shows a schematic view from the top of the window shade with the pull cords and the winding axis with the pull cord entrainment means in its position shortly prior to its engagement with the pull cords.
Figure 7:
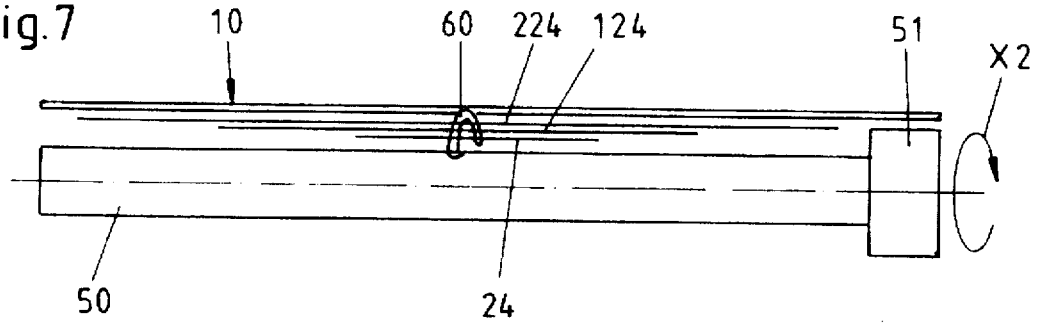
FIG. 7 shows a schematic view from the top of the window shade with the pull cords and the winding axis with the pull cord entrainment means in the position subsequent to having engaged with the pull cords.

In the unrolled state of the window shade 10, the pull cord entrainment means 60 is not assuming its engagement position, i.e. the pull cord entrainment means 60 is on the side which faces away from the window shade 10 and is out of engagement with the pull cord connecting sections 24, 124, 224 within the area A (FIG. 5). If the winding axis 50 is now rotated in the direction of arrow X2 with the aid of the actuating chain 55, then the pull cord entrainment means 60 swings from the position B1 in to the position B2 and, from above, seizes the pull cord connecting sections 24, 124, 224 within the pull cord section area A (FIG. 6). In this case the pull cord entrainment means 60 is configured in a hook-like fashion in such a way that the pull cord entrainment means engages from above into the pull cord connecting sections 24, 124, 224. Up to the engagement of the pull cord entrainment means 60 into these pull cord connecting sections of the pull cords 20, 120, 220, the window shade 10 continues to assume its unrolled position. If the winding axis 50 is rotated further, then the pull cord entrainment means 60 entrains the pull cord connecting sections 24, 124, 224 of the pull cords 20, 120, 220 (FIG. 7). in this case, in a further rotation of the winding axis 50, the pull cord 20, 120, 220 are wound on to the winding axis 50, the window shade 10 being rolled up in the course of this winding up operation (FIG. 8).

Figure 8:
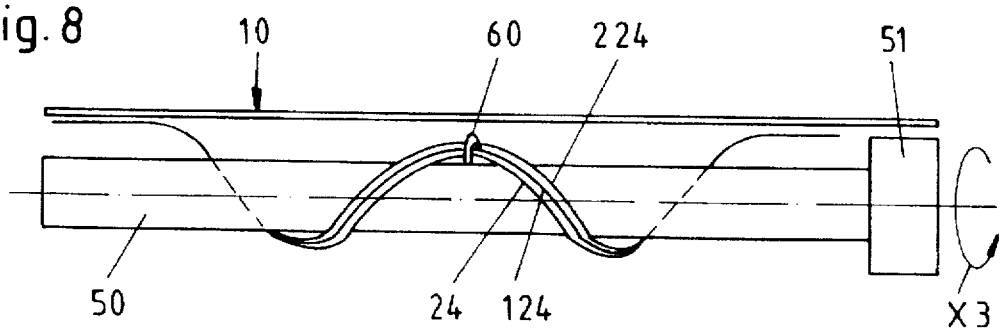
FIG. 8 shows a schematic view from the top of the window shade with the pull cords and the winding axis with the pull cord entrainment means in the position of the winding axis having been rotated further with pull cords having been seized and entrained by the pull cord entrainment means and already partly wound up during the raising operation of the window shade.

Once the rolling up operation of the window shade 10 is terminated, then the roller blind 100 assumes the position depicted in FIG. 8; the pull cord entrainment means 60 is then still in engagement or operative connection with the pull cords 20, 120, 220 within the area of their pull cord connecting sections 24, 124, 224.

If the direction of rotation of the winding axis 50 is changed and the same is rotated in the direction of arrow X3, then an unwinding of the pull cords 20, 120, 220 from the winding axis 50 takes place during a simultaneous execution of the unrolling of the window shade 10 so that, when the unrolling process of the window shade is terminated, i.e. when the window shade 10 assumes the stretched or drawn position shown in FIG. 1, the pull cord entrainment means 60 is moved out of the engagement area to the pull cord connecting sections 24, 124, 224 of the pull cords 20, 120, 220, that is to say the pull cord entrainment means 60 is no longer in operative connection with the pull cords so that the window shade 10 can be separated from its mounting rail 40 of the roller blind 100.

In a construction of the roller blind 100 according to FIG. 2, the pull cord entrainment means 60 is disposed on the winding axis 50 in the center of the winding axis 50, i.e. within the area of the longitudinal center line 11 of the window shade 10, since in this area, by virtue of the disposition of the guide rings 30, 31 and 130, 131 and 230, 231, the pull cord sections of the pull cords 20, 120, 220 to be seized are then located in the circumferential area of the pull cord entrainment means 60.

Figure 11:
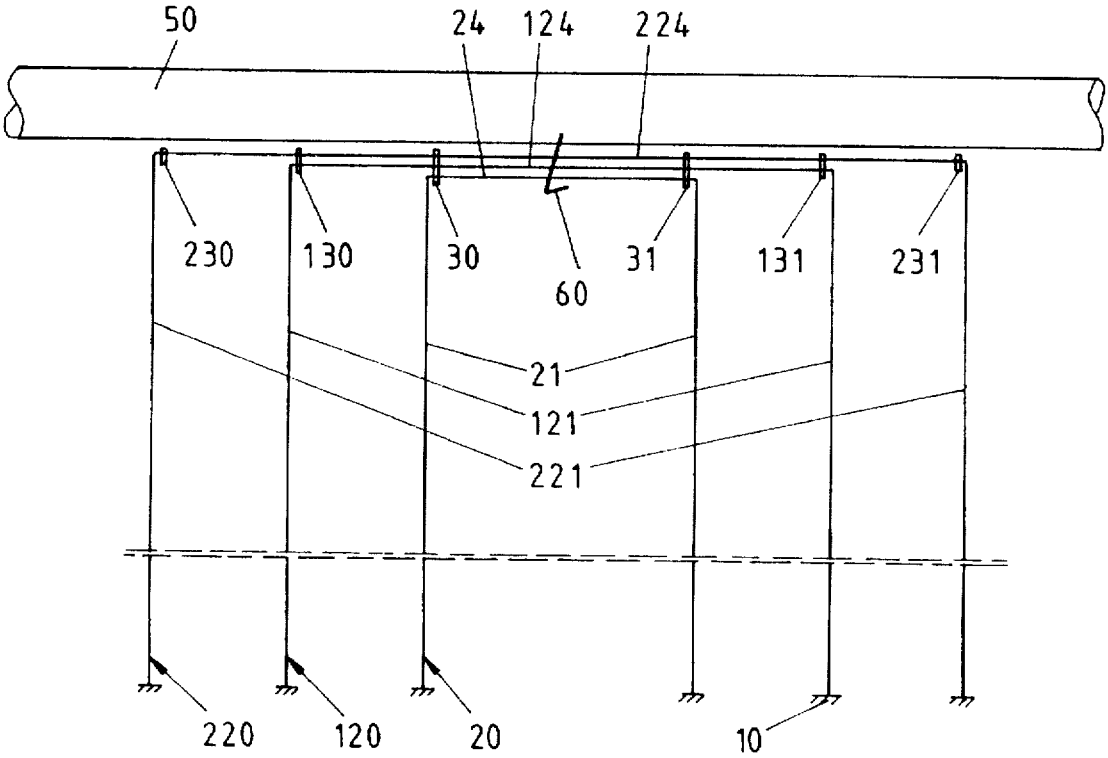
FIG. 11 shows a schematic view of a winding axis with three interlocking pairs of pull cords and with a pull cord entrainment means.

In the winding axis 50 for a roller blind described in the foregoing and schematically represented in FIG. 11, three pull cords 20, 120, 220 in the form of pull cord pairs 21, 121, 221 routed in a U-like fashion are provided, which are passed through guide rings 30, 31 and 130, 131 and 230, 231 arranged in pairs in such a way that in each case three pull cord connecting sections 24, 124, 224 proceeding parallel to each other and to the longitudinal axis of the winding shaft 50, can be jointly seized by a single pull cord entrainment means 60 concentrically secured on the winding axis 50.

Figure 12:
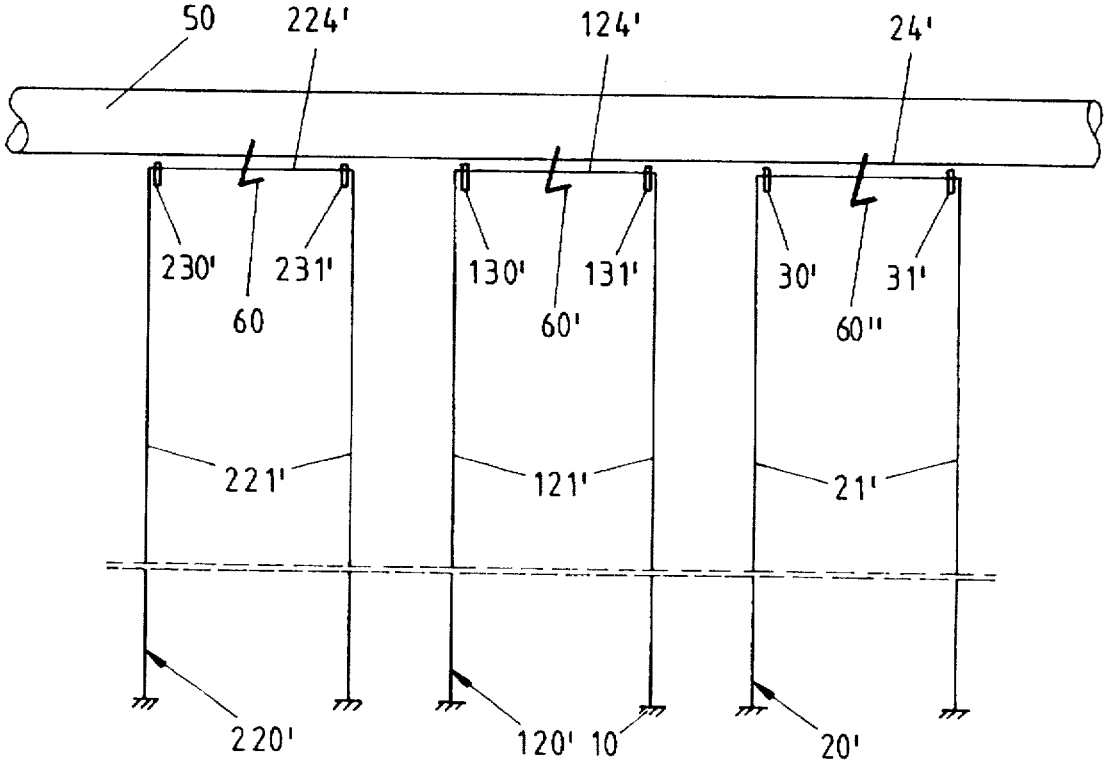
FIG. 12 shows a schematic view of a winding axis with three adjacent pairs of pull cords with three pull cord entrainment means.
Figure 15A:
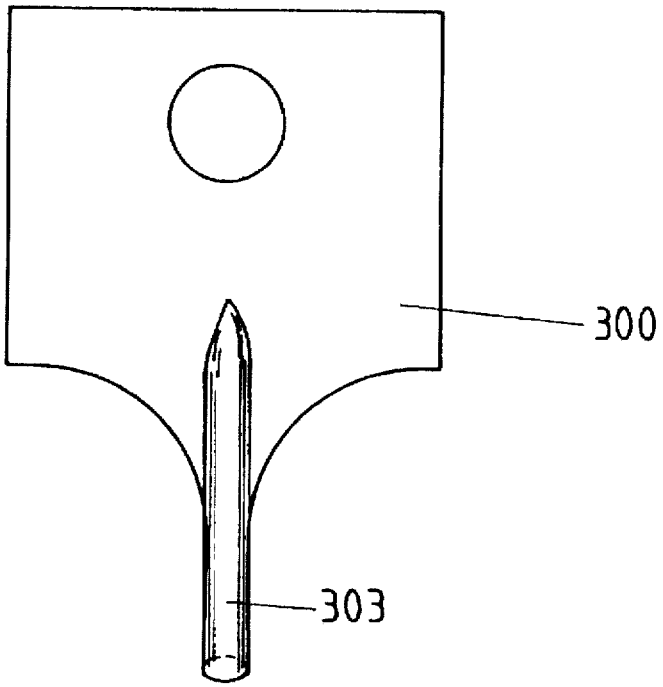
FIG. 15*a* shows a mounting plate with a formed eyelet for the pull cord guidance in a front view.
Figure 15B:
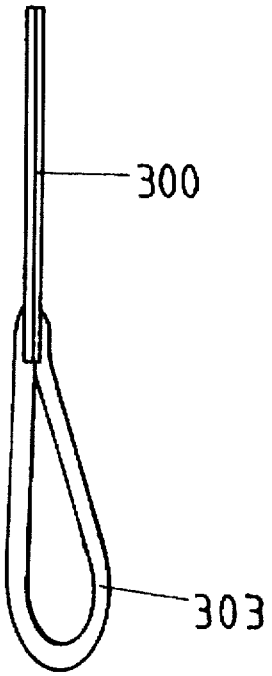
FIG. 15*b* shows the mounting plate as per FIG. 15*a* in a side view.
Figure 16:
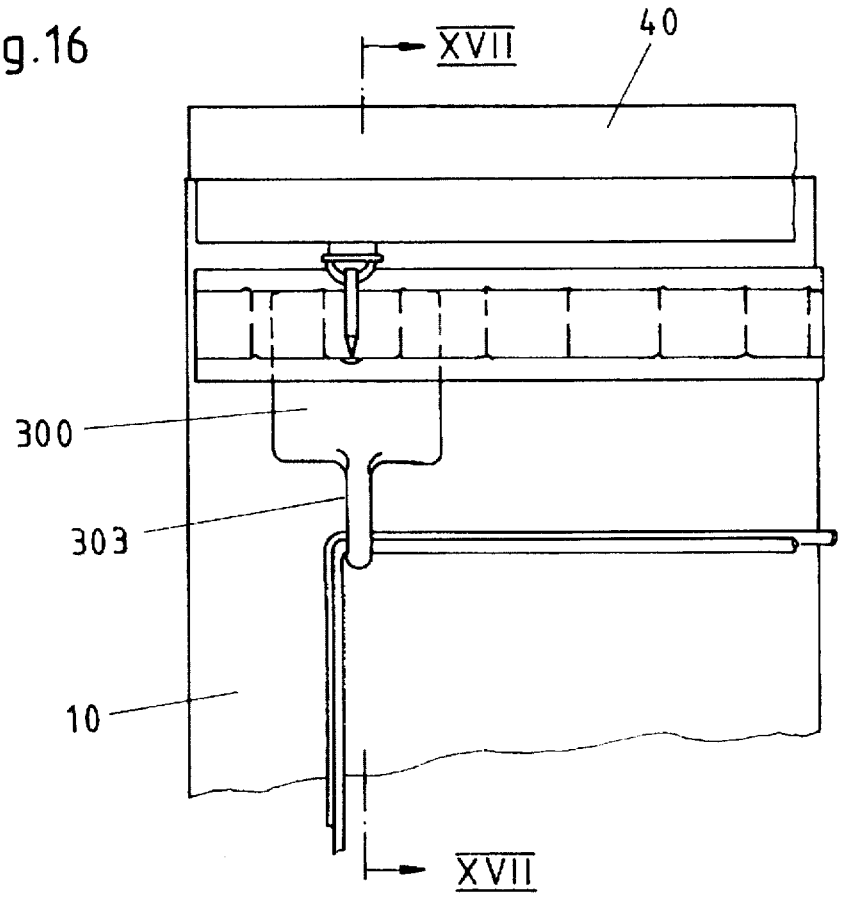
FIG. 16 shows, in a front view, a section of the window shade with the mounting plate for the pull cord guidance.
Figure 17:
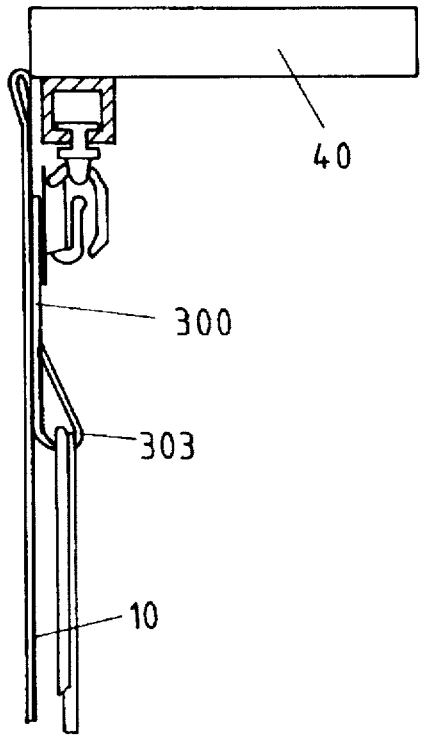
FIG. 17 shows a section in the direction of line XVII—XVII according to FIG. 16.

On the other hand, according to another embodiment as per FIG. 12 it is also possible for provision to be made for more than one pull cord entrainment means, in which case the number of the pull cord entrainment means depends on the number of the U-like routed pull cord pairs 21', 121', 221' of three pull cords 20', 120', 220' and passed through guide rings 30', 31' and 130', 131' and 230', 231' which are combined so as to be paired. In this embodiment, the individual U-like routed pull cord pairs 21', 121', 231' are disposed in a side-by-side arrangement so that the pull cord connecting sections 24', 124', 224' proceeding parallel to the longitudinal axis of the winding shaft 50 are, unlike the embodiment as per FIG. 11, lying on top of each other within the central area so that they can be seized by a single pull cord entrainment means 60, but are located so as to be disposed in series so that, in order to be able to seize the pull cord connecting sections 24',124'*, 224', three pull cord entrainment means 60, 60', 60" are provided, of which each pull cord entrainment means is disposed so as to be concentric to the respective pull cord connecting section 24', 124', 224' on the winding axis 50. The minimum number of U-like routed pull cord pairs for the window shade 10 should be two.

The pull cord entrainment means 60 can be connected rigidly or also detachably to the winding axis 50. In this connection the construction is particularly advantageous according to which, as per FIG. 4, the winding axis 50 is, on its circumference, provided with a longitudinal slot 80, e.g. in the form of a guide groove, which accommodates the carriage-like designed pull cord entrainment means 60 and guides and retains for a longitudinal displacement, which is indicated by the arrows Z. By virtue of this design, the possibility exists for disposing on the winding axis 50, and this by adaptation to the respective requirements, a pertinent and requisite number of pull cord entrainment means 60, in which case, by the displacement of the pull cord entrainment means 60, their distances can be adapted to the pull cord sections to be seized. Moreover, the possibility exists, besides a concentric disposition of a single pull cord entrainment means 60 on the winding axis 50, to also be able to effect an eccentric disposition of the pull cord entrainment means, if this were to become necessary.

Apart from the use of a single winding axis 50, according to a further embodiment as per FIGS. 13 and 14, the possibility exists of arranging at the terminal areas of the mounting rail 40 two winding axes 150, 150', which are constructed in the form of short shafts and which can be provided with pull cord entrainment means 60 in the same way as the winding axis 50. The length of the two winding axes 150, 150' can be selected so as to be any length whatever. It will very largely depend on the width of the window shade 10. Each of the two winding axes 150, 150' is provided with an actuating cord or actuating chain 55. It is also possible for controllable electromotive drive means to be in operative connection with the winding axes 150, 150'.

By the employment of two winding axes 150, 150' possessing short dimensions the possibility is provided while using a simple technique not involving any significant technical expenditure to roll up and/or to spread out the window shade in a fan-like manner.

The employment of a thusly designed roller blind is therefore also possible in gable windows and horizontal semicircular arches and wherever it is impossible to mount a winding axis which is not dimensioned so as to correspond to the width of the window shade.

In order to facilitate the mounting and dismounting of the roller blind, a further embodiment provides guiding and rerouting elements on the window shade 10 for the pull cords, of which each rerouting element is comprised of a mounting plate 300 rigidly connected to the window shade 10 itself, which, in turn, is rigidly connected to a guide eyelet 303 suspended from the same and which is preferably fabricated together with the same from one piece. The mounting plate 300 and the guide eyelet 303 preferably fabricated with the same are comprised of a flexible, sewable and washable plastic, by preference polyamide. This construction produces the advantage that rerouting elements can be fitted virtually punctiformly at any point of the window shade fabric. In this case, the rerouting elements are attached to the front of the window shade material, e.g. sewn on; while the vertical positions of the pull cords and their associated guide elements remain disposed on the rear as before. The top portion of each pull cord is introduced above the topmost guide element through a hole in the window shade fabric to the front of the same into the rerouting element attached to the same—advantageously and expediently as near as possible to the lead-through hole. It is thereby possible to bring the pull cord bundle likewise to the front of the window shade fabric. In a pertinent routing of the pull cords with sections parallel to the winding axis 50, the pull cord entrainment means 60 provided on the winding axis are brought into operative connection with the pull cords (FIGS. 15*a*, 15*b*, 16 and 17).

What is claimed is:

1. In a roller blind including a window shade having an upper marginal edge and a bottom marginal edge, and a mounting rail, wherein the upper marginal edge of the window shade is detachably fastened to the mounting rail, a winding axis rotatably mounted on the mounting rail near the upper marginal edge of the window shade, a drive mounted on one end of the winding axis, a control cord for actuating the drive, a plurality of pull cords for winding onto the winding axis, the pull cords having ends attached to the bottom marginal edge of the window shade, guide loops arranged on the window shades so as to be distributed between the upper marginal edge and the bottom marginal edge of the window shade, the pull cords being guided through the guide loops, and a plurality of guide rings mounted on the winding axis, the pull cords being guided through the guide rings, the improvement comprising, for rolling and unrolling the window shade onto and from the winding axis by the pull cords, the pull cords being arranged in a U-shaped configuration with pairs of pull cord portions extending through the guide rings and concentric pull cord connecting sections extending parallel to the winding axis and arranged one on top of the other, further comprising at least one pull cord entrainment means attached to a circumference of the winding axis.

2. The roller blind according to claim 1, wherein the winding axis has a longitudinal slot extending in longitudinal direction of the winding axis and formed in the circumference of the winding axis, wherein the pull cord entrainment means is mounted in the longitudinal slot so as to be longitudinally displacable and lockable in any position in the longitudinal direction of the winding axis.

3. The roller blind according to claim 1, wherein the guide rings are arranged in a row, wherein a guide ring each is located on both sides of a longitudinal middle line of the window shade, so that the pull cord connecting section is located in an engagement range of the pull cord entrainment means of the winding axis.

4. The roller blind according to claim 1, wherein two guide rings for each pair of pull cords are arranged at equal distances from a longitudinal middle line of the window shade.

5. The roller blind according to claim 1, wherein the pull cord entrainment means is arranged on the winding axis adjacent a longitudinal middle line of the window shade.

6. The roller blind according to claim 1, wherein the pull cord entrainment means is hook-shaped.

7. The roller blind according to claim 1, wherein the pull cord entrainment means comprises a shaped member having a hook-shaped portion integrally connected to the shaped member, the winding axis having a recess for receiving the shaped member of the pull cord entrainment means, wherein the pull cord entrainment means is secured in the recess by one of a press fit, a screwed connection or a bonded joint.

8. The roller blind according to claim 1, wherein the window shade is detachably fastened to the mounting rail with a hook and loop connecting means.

9. The roller blind according to claim 1, comprising for actuating the window shade at least two pairs of pull cords arranged in a U-shaped configuration, the pairs of pull cords being arranged side-by-side and each forming a pull cord connecting section extending parallel to the winding axis and being guided through two guide rings, a pull cord entrainment means mounted for each pull cord connecting section on the winding shaft, wherein the number of pull cord entrainment means corresponds to the number of pairs of pull cords.

10. The roller blind according to claim 1, comprising guide elements and rerouting elements for the pull cords mounted on the window shade, each rerouting element being comprised of an attachment plate rigidly connected to the window shade, wherein the window shade is rigidly connected to a guide eyelet suspended from the attachment plate.

11. The roller blind according to claim 10, wherein the eyelet and the attachment plate are constructed in one piece.

12. The roller blind according to claim 10, wherein the attachment and the guide eyelet are of a flexible synthetic material which is sewable and washable.

13. The roller blind according to claim 12, wherein the synthetic material is polyamide.

14. The roller blind according to claim 1, wherein the at least one pull rod entrainment means is attached concentrically to the circumference of the winding axis.

15. The roller blind according to claim 1, wherein the at least one pull rod entrainment means is attached eccentrically to the circumference of the winding axis.

16. In a roller blind including a window shade having an upper marginal edge and a bottom marginal edge, and a mounting rail, wherein the upper marginal edge of the window shade is detachably fastened to the mounting rail, a winding axis rotatably mounted on the mounting rail near the upper marginal edge of the window shade, a drive mounted on one end of the winding axis, a control cord for actuating the drive, at least one pull cord for winding onto the winding axis, the pull cord having ends attached to the bottom marginal edge of the window shade, guide loops arranged on the window shades so as to be distributed between the upper marginal edge and the bottom marginal edge of the window shade, the pull cord being guided through the guide loops, and a plurality of guide rings mounted on the winding axis, the pull cord being guided through the guide rings, the improvement comprising the at least one pull cord extending on a rear side of the window shade in a U-shaped configuration through two guide rings attached to the window shade adjacent to the upper marginal edge, the pull cord having two pull cord sections extending transversely of the winding axis and with free ends being attached to the lower marginal edge of the window shade, the pull cord further having a connecting section extending between the two guide rings and parallel to the winding axis for connecting the pull cord sections extending transversely of the winding axis, further comprising a pull cord entrainment means mounted on a circumference of the winding axis so as to be located with a revolving range at the pull cord connecting section, wherein, in an unrolled state of the window shade, the entrainment means is out of engagement from the pull cord connecting section and, for winding up the pull cord sections onto the winding axis, the entrainment means engages the pull cord connecting section during rotation of the winding axis.

17. In a roller blind including a window shade having an upper marginal edge and a bottom marginal edge, and a mounting rail, wherein the upper marginal edge of the window shade is detachably fastened to the mounting rail, a winding axis rotatably mounted on the mounting rail near the upper marginal edge of the window shade, a drive mounted on one end of the winding axis, a control cord for actuating the drive, a plurality of pull cords for winding onto the winding axis, the pull cords being mounted on a rear side of the window shade and having ends attached to the bottom marginal edge of the window shade, guide loops arranged on the window shades so as to be distributed between the upper marginal edge and the bottom marginal edge of the window shade, the pull cords being guided through the guide loops, and a plurality of guide rings mounted on the winding axis, the pull cords being guided through the guide rings, the improvement comprising each pull cord comprising at least a pair of pull cord sections extending over an entire length of the window shade and extending at a distance between each other, the pull cord further comprising a pull cord connecting section extending parallel to the upper marginal edge of the window shade and two guide rings detachably connected to the window shade for each pair of pull cord sections, further comprising a pull cord entrainment means mounted on a circumference of the winding axis so as to be located with a revolving range at the pull cord connecting section, wherein, in an unrolled state of the window shade, the entrainment means is out of engagement from the pull cord connecting section, and for winding up the pull cord sections onto the winding axis, the entrainment means engages the pull cord connecting section during rotation of the winding axis.

18. In a roller blind including a window shade having an upper marginal edge and a bottom marginal edge, and a mounting rail, wherein the upper marginal edge of the window shade is detachably fastened to the mounting rail, a winding axis rotatably mounted on the mounting rail near the upper marginal edge of the window shade, a drive mounted on one end of the winding axis, a control cord for actuating the drive, a plurality of pull cords for winding onto the winding axis, the pull cords having ends attached to the bottom marginal edge of the window shade, guide loops arranged on the window shades so as to be distributed between the upper marginal edge and the bottom marginal edge of the window shade, the pull cords being guided through the guide loops, and a plurality of guide rings mounted fixedly or detachably on the winding axis, the pull cords being guided through the guide rings, the improvement comprising the window shade having on a rear side thereof three pull cords each having two pull cord sections extending transversely of the winding axis and one pull cord connecting section connecting the pull cord sections extending transversely of the winding axis, wherein, for deflecting the pull cords of each pair of pull cord sections, two guide rings each are provided adjacent the upper marginal edge of the window shade, wherein the guide rings are arranged in a row, wherein a guide ring each is located on both sides of a longitudinal middle line of the window shade, so that the pull cord connecting section is located in an engagement range of the pull cord entrainment means of the winding axis.

* * * * *